United States Patent [19]

Whitehouse et al.

[11] Patent Number: 4,583,706

[45] Date of Patent: Apr. 22, 1986

[54] MOUNTING AND STOWING ARRANGEMENTS FOR ROLLING DOORS

[75] Inventors: Martin H. Whitehouse, Northmead, Australia; Robert L. Combs, Huntington Beach, Calif.

[73] Assignee: Byrne & Davidson Doors (N.S.W.) Pty. Limited, Revesby, Australia

[21] Appl. No.: 396,873

[22] Filed: Jul. 9, 1982 (Under 37 CFR 1.47)

[30] Foreign Application Priority Data

Jul. 10, 1981 [AU] Australia ..... PE9694

[51] Int. Cl.[4] ..... A47H 1/14

[52] U.S. Cl. ..... 248/251; 248/268; 160/133; 160/323 B

[58] Field of Search ..... 160/133, 26, 319, 323 B; 248/262, 3, 264, 266, 267, 268, 251

[56] References Cited

FOREIGN PATENT DOCUMENTS

| | | | |
|---|---|---|---|
| 107082 | 9/1937 | Australia . | |
| 132201 | 4/1949 | Australia | 160/133 |
| 447510 | 6/1972 | Australia . | |
| 1813491 | 8/1969 | Fed. Rep. of Germany | 160/133 |

*Primary Examiner*—Ramon S. Britts
*Assistant Examiner*—David M. Purol
*Attorney, Agent, or Firm*—Pennie & Edmonds

[57] ABSTRACT

A bracket for use in mounting a roller door assembly to a wall comprises a plate having a bearing for support of a drum or end drum, the bearing being closer to one edge of the plate than another, and edge flanges whereby the bearing may be mounted at either of two distances from the wall. Preferably the edge flanges have interengageable formations facilitating stacking of door roller assemblies with the flanges of the brackets edge to edge.

5 Claims, 11 Drawing Figures

MOUNTING AND STOWING ARRANGEMENTS FOR ROLLING DOORS

This invention relates to a mounting and stowing arrangement for a rolling shutter or door.

Rolling doors of the kind comprising a rotatable drum extending horizontally above a doorway and a link slat shutter which may be wound onto, or unwound from, the drum as from time to time desired are well known and have been extensively used as closures for garage doorways.

More recently doors of that type have included those in which the curtain is manufactured from a continuous sheet and those in which the curtain is rolled onto spaced apart end drums to form a roll which is self supporting therebetween.

The present invention provides a mounting arrangement which in preferred embodiments facilitates manufacture and/or installation of rolling doors.

According to one aspect the invention consists in a bracket for use in mounting a roller door assembly to a wall, said bracket comprising:

a plate having bearing means for providing support to a drum or end drum of a rolling door, an edge flange of said plate being at a distance from the bearing means whereby the plate may be mounted to a wall with the bearing means cantilevered at a distance from the wall, and an edge flange at another distance from the bearing means whereby the bearing means may be cantilevered at a different distance from the wall.

According to a second aspect the invention consists in a bracket according to the first aspect wherein the plate is rectangular and has edge flanges on two opposite edges, the first edge flange having formations inter-engageable with formations of the second edge flange of a like bracket, whereby a plurality of rolling door assemblies having brackets at each end may be stacked with the brackets of one assembly in nesting engagement with the corresponding brackets of a like assembly.

An embodiment of the invention will now be described by way of example only with reference to the accompanying drawings wherein.

Figure 2:
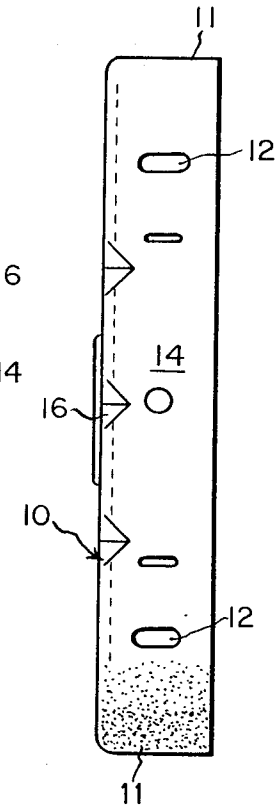
FIG. 2 shows the embodiment of FIG. 1 in end elevation with parts omitted for clarity.
Figure 1:
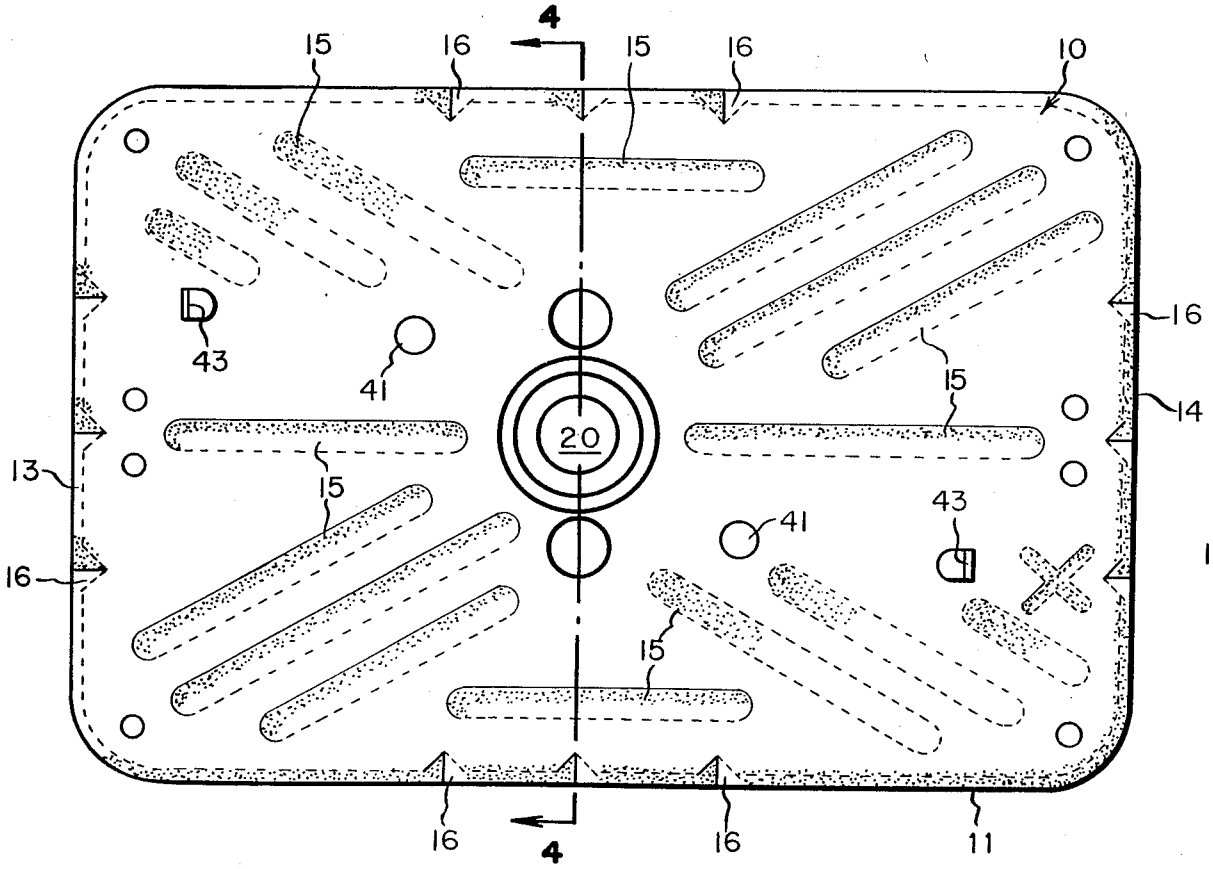
FIG. 1 shows a mounting bracket according to the invention in side elevation.
Figure 4:
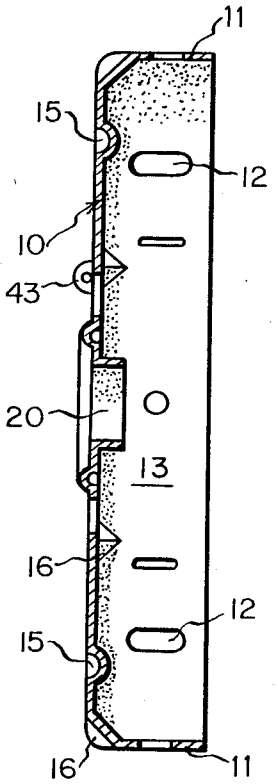
FIG. 4 shows a section through the embodiment of FIG. 1 taken on line 4—4.
Figure 3:
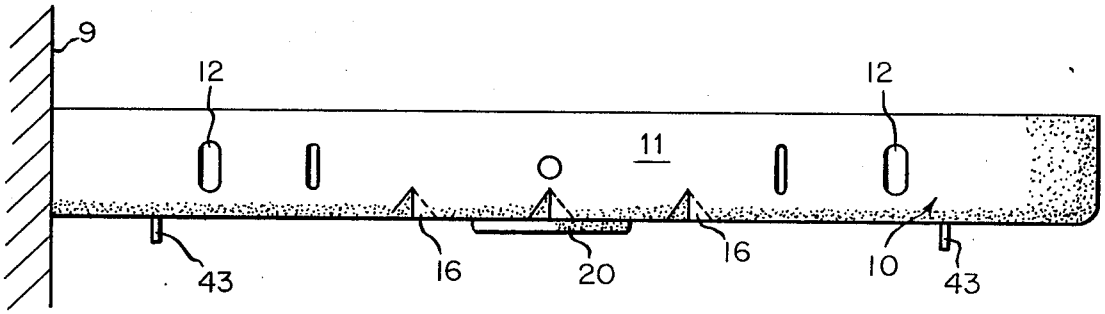
FIG. 3 shows the embodiment of FIG. 1 in plan view.

With reference to FIGS. 1 to 4 there is shown a bracket comprising a rectangular plate 10 having a perpendicular flange 11 extending along its perimeter. The shorter sides of the plate 13, 14 are each provided with two holes 12 in the corresponding flange portions thereof whereby plate 10 may be mounted in cantilever manner from a wall 9 as shown in FIG. 3 by fastenings extending through either the apertures 12 of the flange on side 13 or alternatively by means of fastenings extending through the apertures 12 of the flange on side 14. A bearing 20, comprising a socket having a circumferential flange 21 extending therefrom in the same direction in which the flange 11 extends, is centered in plate 10 slightly closer to side 13 than to side 14. In the present example bearing 20 is centered 9 inches from side 13 and 10 inches from side 14. The arrangement thus permits the bracket to be mounted so that the bearing is centered at 10 inches or at 9 inches from the wall in accordance with the requirements of the roll diameter of the curtain.

Plate 10 is stiffened with flutes 15 extending from adjacent the bearing to adjacent the perimeter, and flange 11 is rigidified by dimples or detents 16. Plate 10 is also provided with a pressed out bracket 43 and a boss 41 to receive a pawl spring to be described hereinafter. Flutes 15 are omitted from FIGS. 2–3 for improved clarity as are elements 41 and 43 from FIG. 2.

Figure 6:
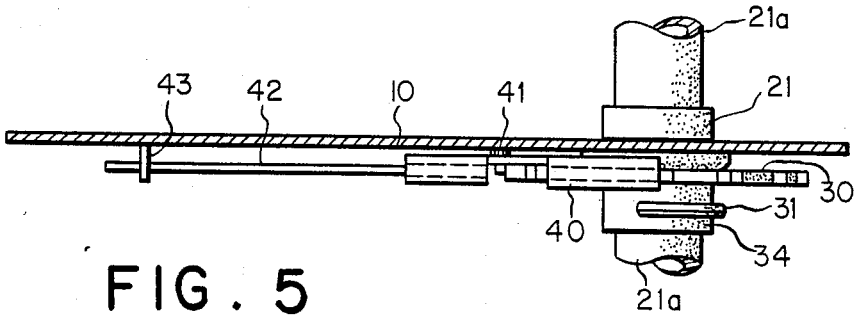
FIGS. 6 and 7 show plan and end views respectively of the portion shown in FIG. 5.
Figure 5:
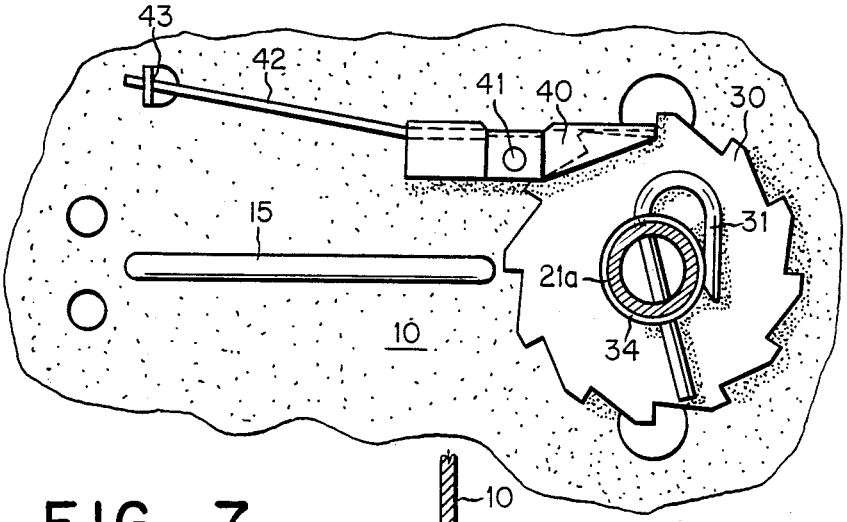
FIG. 5 shows a portion of the embodiment of FIG. 1 with pawl and ratchet means mounted thereto.
Figure 7:
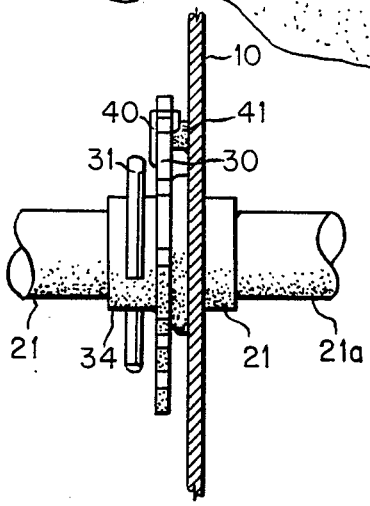

In use, an end drum (not shown in the drawings) is mounted by a shaft 21*a* supported by bracket bearing 20 as shown in FIGS. 5–7. Plate 10 is mounted to the wall so that the shaft 21*a* is perpendicular to the plate 10.

A ratchet sprocket 30 is mounted to shaft 21*a* and is keyed to the shaft by a "U" shaped retaining spring 31. One arm 31 of the spring is longer than the other and extends through a hole piercing mounting boss 34 of sprocket 30 and through shaft 21*a*.

The gap between the arms of the "U" of spring 31 is normally less than the radial dimension of shaft 21*a* but is extensible to permit insertion of the shaft therebetween. The "U" arms are not parallel, the diameter of the loop being slightly larger than the gap between them at its narrowest and the short arm being chamfered adjacent the gap.

A pawl 40 having a generally "U" shaped section straddles the sprocket and is pivotally mounted on a boss 41 pressed from plate 10.

Pawl 40 is spring loaded by means of a spring wire pigtail 42 which extends from the side 13 remote from ratchet sprocket 30 and which passes through a bracket 43 pressed out of the plane of plate 10.

A corresponding boss 41 and bracket 43 are pressed from plate 10 on the side of bearing 20 nearer to side 14 so that the pawl may be mounted on either side depending on which side of plate 10 is mounted to the wall.

For preference the upper edge flange 11 is provided with dimples or other formations (see FIGS. 9–11) and the lower edge flange 11 is provided with formations inter-engageable with those of the upper flange whereby the brackets may be stacked in nesting engagement flange to flange.

This greatly facilitates storage and shipment of door assemblies.

More preferably the interengageable formations permit such stacking in an arrangement similar to a stretcher bond brick laying arrangement and in which a lower flange of one bracket is interengaged with the upper flange of each of two abutting and underlying brackets. In that way a compact stowing of door assemblies may be achieved notwithstanding that the diameter of a shutter roll assembled with brackets may have a greater diameter than the shortest edge of the plate (see FIG. 8).

Figure 8:
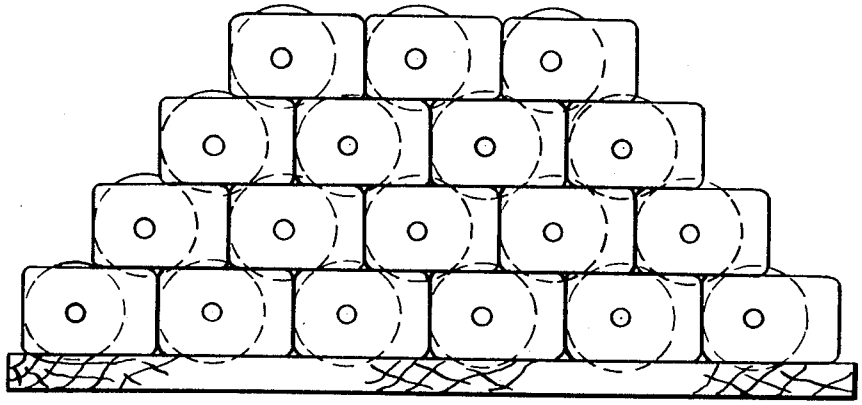
FIG. 8 shows a plurality of roller door assemblies in stacked engagement.
Figure 9:
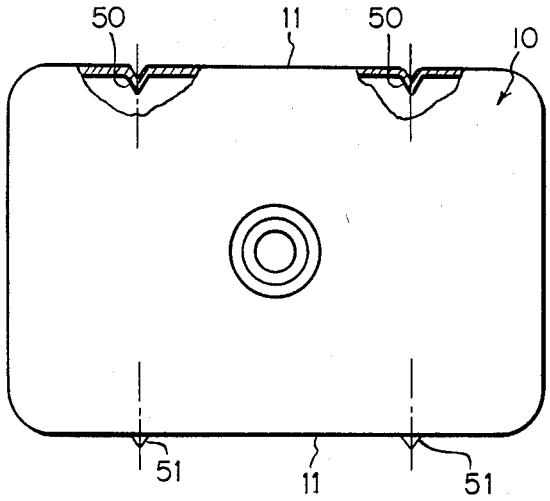
FIG. 9 is a side elevation of the bracket similar to FIG. 1 with certain details removed for sake of simplicity in showing the inter-engageable formations on its upper and lower side flanges.
Figure 10:
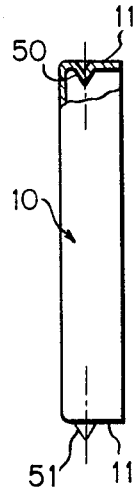
FIG. 10 is an end elevation of the bracket of FIG. 9.
Figure 11:
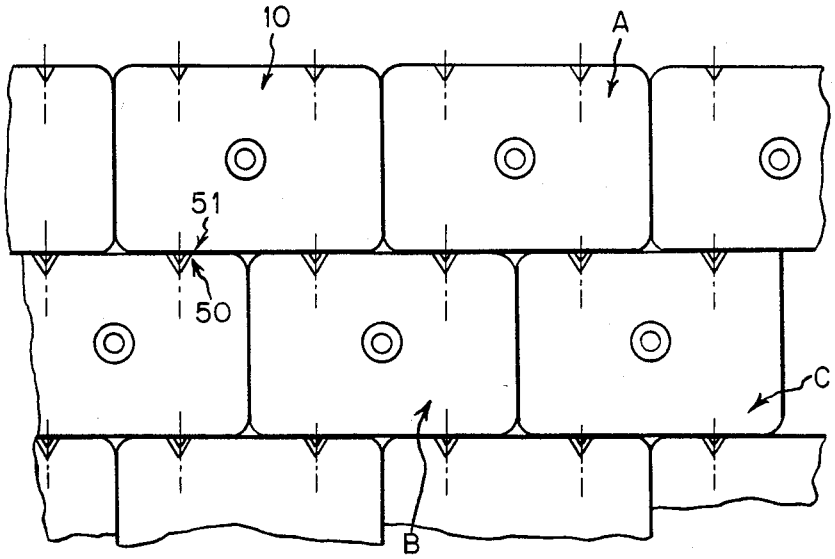
FIG. 11 is a view similar to FIG. 8 showing a plurality of brackets in stacked arrangement with the respective formations inter-engaging.

FIGS. 9 and 10 are side and end elevations of the bracket and show the inter-engageable formations referred to above. In particular, the upper edge flange 11 of the plate 10 has dimples 50 formed therein, and the lower edge flange has inter-engaging formations 51 directly opposite the dimples 50. The location of the formations on the flanges are selected so as to permit stacking a plurality of brackets in a stretcher bond arrangement as shown in FIGS. 8 and 11. As stated above, all that is required is that the formations on the lower flange of each bracket (for example, bracket A in FIG. 11) inter-engaged with formations on the upper flange of two abutting and underlying brackets (B and C in FIG. 11).

It will be understood that in other embodiments (not illustrated) bearing 20 may be situated such that its distance from the edge flanges may differ in all four directions. For example it may be located at 8", 9", 10" and 11" from respective sides of rectangular plate 10.

The bracket of the invention may be made by stamping and passing operations and by use thereof the inventory of parts needed for the manufacture of roller doors may be reduced.

We claim:

1. A bracket for use in mounting a roller door assembly to a wall, said bracket comprising:

a rectangular plate having two side flanges and two end flanges, and having bearing means for provision of support to a drum or end drum of a rolling door, said bearing means defining an axis which is parallel to said flanges, one end flange of said plate being at a distance from the bearing means and having apertures therein for receiving mounting means for mounting the plate to a wall with the flange in engagement therewith with the bearing means cantalevered at said distance from the wall, the other end flange being at another distance from the bearing means and having apertures therein for receiving mounting means for mounting the plate with the flange in engagement with the wall whereby the bearing means may be cantilevered at said other distance from the wall, where either one of said end flanges is to be used for mounting said bracket by mounting means, and means on said bracket for mounting other structure associated with the roller door mounted thereon.

2. A bracket for use in mounting a roller door assembly to a wall, said bracket comprising:

a rectangular plate having two side flanges and two end flanges, and having bearing means for provision of support to a drum or end drum of a rolling door, said bearing means defining an axis which is parallel to said flanges, one end flange of said plate being at a distance from the bearing means and having apertures for receiving mounting means for mounting the plate to a wall with the bearing means cantilevered at said distance from the wall, the other end flange being at another distance from the bearing means and having apertures therein for receiving mounting means for mounting the plate to the wall whereby the bearing means may be cantilevered at said other distance from the wall, said two side flanges being on opposite sides of said rectangular plate, one of said side flanges having thereon first formations and the other of said side flanges having thereon second formations inter-engageable with said first formations whereby the respective formations on pairs of abutting brackets may be inter-engaged to form a nested arrangement of such brackets with the formations on the lower side flange of a given bracket inter-engaged with formations on the upper side flanges of two underlying brackets, said underlying brackets further abutting each other at their end flanges so the rolls of any row of bracket assemblies are offset from the rolls of the contiguous rows, permitting rolls of a diameter larger than the dimension between said side flanges to be used in the bracket assemblies without preventing the bracket nesting.

3. A bracket according to claim 1 or 2 wherein the plate is rigidified by flutes.

4. A bracket according to claim 1 or 2 wherein the flanges are rigidified by dimples or detents.

5. A rolling door subassembly comprising a bracket according to claim 1 or 2 and a drum or end drum of a rolling door mounted to said bearing means.

* * * * *